US005492152A

United States Patent [19]

Kikuchi et al.

[11] Patent Number: 5,492,152

[45] Date of Patent: Feb. 20, 1996

[54] CREEL WITH TWISTING DEVICE

[75] Inventors: Koichi Kikuchi; Mitsuyuki Kitagawa, both of Shimada, Japan

[73] Assignee: Kikuchi Kogyo Co., Ltd., Japan

[21] Appl. No.: 430,288

[22] Filed: Apr. 28, 1995

Related U.S. Application Data

[63] Continuation of Ser. No. 119,057, filed as PCT/JP92/01202, Sep. 21, 1992, published as WO94/06958, Mar. 31, 1994.

[51] Int. Cl.[6] ..... D03J 1/02; D03D 49/16

[52] U.S. Cl. ..... 139/97; 28/172.1; 57/59; 242/131; 242/131.1

[58] Field of Search ..... 57/59; 139/97, 139/450; 242/131, 131.1; 28/172.1, 190

[56] References Cited

U.S. PATENT DOCUMENTS

| | | | |
|---|---|---|---|
| 1,522,377 | 1/1925 | Longvall | 242/131 X |
| 3,477,661 | 11/1969 | Emerson et al. | 242/131 |
| 3,867,809 | 2/1975 | Holbrook | 57/59 |
| 3,981,130 | 9/1976 | Aimbinder et al. . | |
| 4,789,008 | 12/1988 | Kikuchi | 139/97 |

FOREIGN PATENT DOCUMENTS

| | | |
|---|---|---|
| 2567113 | 2/1986 | France . |
| 302833 | 4/1930 | Japan . |
| 53-49872 | 11/1978 | Japan . |
| 53-69555 | 11/1978 | Japan . |
| 58-14935 | 3/1983 | Japan . |
| 62-53451 | 3/1987 | Japan . |
| 1-275373 | 11/1989 | Japan . |

*Primary Examiner*—Andy Falik
*Attorney, Agent, or Firm*—Harris Beach & Wilcox

[57] ABSTRACT

A creel for directly supplying twisted yarns to a machine (13) such as a loom or warper from a plurality of yarn bobbins (3) arranged on a creel (1) for holding non-twisted yarn (2). Two banks of bobbins (3), optionally contrarotate at a predetermined speed to respectively provide "S-twisted" and "Z-twisted" yarn streams (4) having a desired twist number. The bobbins (3) are disposed on a plurality of spindles (5) that are driven by suitable drives (6). A bobbin attachment (7) is mounted at a free end of each bobbin (3) and fixedly supported on the spindle (5). A yarn storage (8) is provided on the attachment (7) and includes a yarn adjustment ring (9) for providing yarn delivery in a stable manner under appropriate tension. Once the yarn has passed the yarn storage (8) and yarn adjustment ring (9), a desired twist is imparted to the yarn (2), and twisted yarn (4) is delivered to the machine (13).

9 Claims, 7 Drawing Sheets

CREEL WITH TWISTING DEVICE

This is a continuation of application Ser. No. 08/119,057 filed as PCT/JP92/01202, Sep. 21, 1992, published as WO94/06958, Mar. 31, 1994, now abandoned.

FIELD OF THE INVENTION

The present invention relates to a creel for twisting non-twist yarn and supplying the same to a predetermined machine such as a loom or a warper.

BACKGROUND ARTS

For the production of a belt-like woven cloth in the prior art, while using a twist yarn as a warp, such as a safety belt or a sling, there is a method in which a beam is prepared by winding thereon a predetermined number of twist yarns before a weaving operation, or a method in which a bobbin is formed by winding thereon a preliminarily prepared twist yarn and a plurality of the bobbins are arranged on a creel to be supplied to a loom as warps.

There are problems when a twist yarn is used for a weaving operation as a warp yarn. That is, it is necessary to vary a twist number in accordance with the use of a woven cloth and/or specific properties of the yarn so that the required feeling to the touch is obtained in the resultant cloth. Since a yarn twisting is not usually carried out by a weaver but is done by an outside twister, it is almost impossible to change a twist number after the yarn twisting has been completed, even if it has been found that the twist number is unsuitable for the desired cloth. Also, since it is not certain that the same length of twist yarn is wound on the respective bobbin, a waste of the twist yarn may be generated due to this difference of the yarn length between the bobbins.

Moreover, since a length of the twist yarn wound on a bobbin is at most one half, usually less than one third of that of a large packaged material yarn bobbin, a troublesome bobbin exchanging and yarn tying operation is necessary midway in the weaving process, and, in some uses, the resultant product may be inferior in the tied portion and cannot be used. As stated above, when a cloth is woven while a twist yarn is used as a warp yarn, there are more inconveniences compared with a case when non-twist yarns are directly supplied to a loom from a creel.

On the other hand, when a non-twist yarn is used as a warp yarn and is directly supplied from a creel, it is almost unnecessary to tie original yarns to each other during the weaving process, because the yarns are supplied from the respective large packaged bobbins. Further since an unwinding process and a warping process can be eliminated and a yarn twisting through an outside twister is unnecessary, the productivity thereof is superior to that of the former. However, there are several problems in the product quality in that the feeling to the touch is limited to a narrow range, resiliency is poor and durability against abrasion is inferior. In addition, there are also problems in the weaving process in that many fluffs occur in the warps due to filament breakages in non-twisted yarns, because of which in an extreme case the loom must be stopped and returned to a normal state.

To solve the above problems, the present inventors proposed in Japanese Patent Application No. 57-029084 a creel in which a plurality of bobbins are arranged, each carrying a non-twist yarn thereon and provided with a twisting device similar to a flyer mechanism, and the non-twist yarn is delivered from the bobbin and simultaneously twisted thereby. According to this creel, the non-twist yarn in a large packaged bobbin can be supplied to a loom while being twisted but there is a serious problem in that the installation cost is expensive.

To obtain effects similar to the above apparatus at a relatively lower installation cost, in Japanese Patent Application No. 60-189847, a creel was proposed using a ring/traveller type twisting mechanism. Thereby, the structure became more simple and the installation cost was reduced relative to the former structure. Accordingly, various inconveniences could be solved, which occur when the weaving operation is carried out by using the twisted yarn. However, this was not a perfect solution to the problems inherent in the prior art because the installation cost is not drastically reduced compared with a cost for the yarn twisting process.

In addition, in the above two prior art, a spindle driving means constituting a main part of the twisting mechanism is described as a combination of shaft and bevel gears, which is so complicated in structure that a reduction in the installation cost is prevented.

In Japanese Patent Application No. 60-189847, an apparatus is disclosed, which supplies twist yarns having S twist and Z twist, respectively. In this apparatus, although a rotational direction of the spindle can be changed by varying a belt wrapping arrangement while using a single motor, or by using two driving systems, it is not clear that the rotational speed, that is, the twist number is variable.

Further, in the above two documents, while there is only a disclosure in that a material yarn formed on a straight paper tube (cylindrical paper tube) is used, there is no disclosure regarding the use of a tapered paper tube or an aluminum pirn, from which a yarn is withdrawn in one direction.

If twist yarns are supplied to a loom for weaving a cloth of a simple design, the abovesaid prior art can be satisfactorily applied.

However, in a complicated cloth in which yarns of various kinds and/or of thickness are mixed, it is necessary to use an apparatus which can change not only a rotational direction but also a rotational speed (twist number) of a yarn to be treated. Moreover, a creel is desired which can be also used for bobbins other than a straight paper tube.

It is a primary object of the present invention to provide a method for directly supplying twist yarns from a creel to a loom, which can stand comparison with the prior art in which non-twist yarn is supplied directly from a creel to a loom. It is a secondary object of the present invention to provide an improved creel in which a twist number and a twist direction of the supplied yarn can be changed if necessary and which has advantages in that the selection range of bobbin shape on which a non-twist yarn to be treated is wound can be widened to a great extent, the use thereof can be extended, and drastic reduction in the installation cost is possible.

SUMMARY OF THE INVENTION

The present invention has the following constituent features for achieving the above objects.

According to a first aspect of the present invention, a creel is provided for supplying twist yarns to a predetermined machine in parallel to each other, each of which is prepared by withdrawing a non-twist yarn from one of multiple bobbins arranged on the creel and twisting the non-twist yarn midway of the supply passage thereof to the predetermined machine, comprising a plurality of spindles, each supporting a respective bobbin and at least one means for driving the spindles in an optional rotational direction and at an optional rotational speed, and an attachment with a yarn storage mounted at a tip end of the bobbin fixedly supported on the spindle and on which a yarn adjustment ring is fitted, wherein after the non-twist yarn withdrawn from the bobbin passes the yarn storage and the yarn adjustment ring while directed to the predetermined machine, a twist is imparted to the non-twist yarn to obtain a twist yarn.

According to a second aspect of the present invention, a creel is provided, comprising a plurality of spindles, each fixedly supporting a bobbin on which a non-twist yarn is wound so that the bobbin is rotatable together with the spindle and at least one means for driving spindles, in which a twist is imparted to the non-twist yarn while the non-twist yarn is withdrawn from the bobbin and supplied to a predetermined machine, wherein each of the spindles is a single spindle having at least two bearings 30 in the middle portion thereof as seen from the front side and extending right/leftward to form holders for fixedly supporting the bobbins, and a plurality of the spindles are arranged to form multiple horizontal rows positioned in a multistage manner in the vertical direction as seen from the lateral side; all the spindles being driven in a predetermined rotational direction by a single motor and a gearing means, while rotational speed thereof is variable.

Preferably the means for driving spindles is a plurality of systems, each comprising a motor and a gearing means so that the respective system can change the rotational direction and the rotational speed of the spindle.

According to the adoption of the above novel techniques, it is possible to reduce the number of parts necessary for the construction of this kind of creel as well as drastically cut down the installation cost because inexpensive materials can be used therefor.

In this regard, since "yarn adjustment ring", "yarn storage" and "bobbin attachment" are completely novel parts for constructing a twisting apparatus and are newly defined in this specification by the present inventors, these will be described later in more detail.

BRIEF DESCRIPTION OF THE DRAWINGS

FIGS. 5(A)–(C) illustrate one embodiment of a bobbin attachment used for the present invention, wherein FIG. 5(A) shows a bobbin attachment to be fitted on a bobbin on which a non-twist yarn is wound, FIG. 5(B) shows a yarn adjustment ring (O-ring) to be mounted on the bobbin attachment of FIG. 5(A) and FIG. 5(C) shows another yarn adjustment ring to be mounted on the bobbin attachment of FIG. 5(A);

DESCRIPTION OF THE PREFERRED EMBODIMENTS

As stated above, a novel technique is used in a creel according to the present invention, that is, this creel is different from that of the prior art and provided with a new twisting apparatus.

Figure 2:
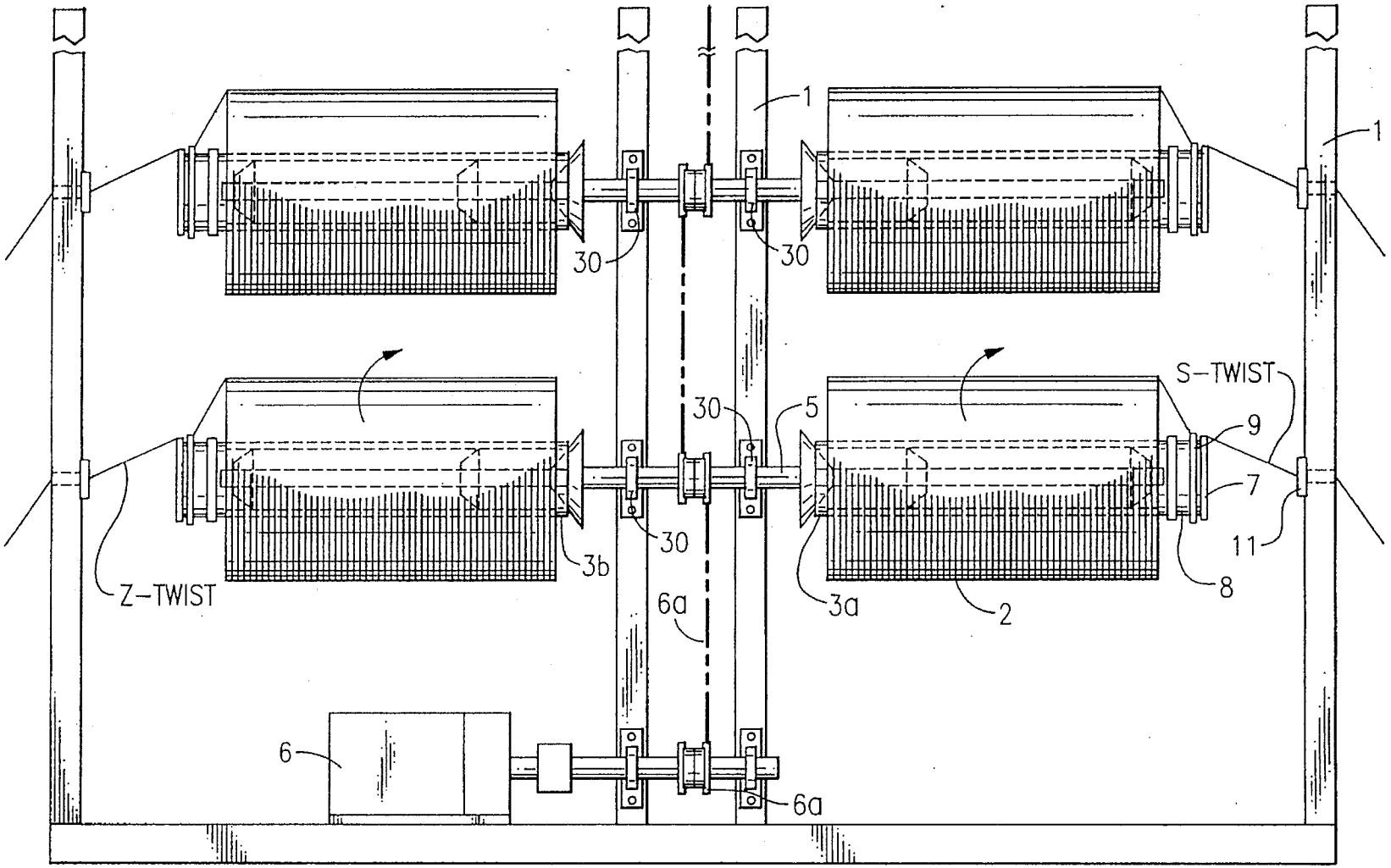
FIG. 2 illustrates one embodiment of a spindle drive means and a twisting mechanism according to the present invention.

According to the creel of the present invention, as shown in FIG. 2, a bobbin carrying a non-twist yarn and fixedly supported by a spindle rotates so that the yarn is unwound, in which a size of ballooning varies in accordance with a position at which the non-twist yarn is released from the bobbin. A yarn length withdrawn from the bobbin also varies as the ballooning size changes.

Since the non-twisted yarn is restricted not to freely be drawn out by the action of the yarn adjustment ring provided at an exit of the yarn storage in the bobbin attachment, a leading end of yarn excessively released in accordance with the variation of the ballooning is temporarily stored on the yarn storage by wrapping around it.

A length of the wrapping yarn varies in accordance with the variation of the ballooning so that yarn withdrawal is controlled.

In addition, the yarn adjustment ring has functions for imparting substantially a constant tension to the withdrawn yarn as well as maintaining a constant twist number in the yarn, because the twist is imparted to the yarn after the yarn has passed the exit.

According to the action of the combination of storage and yarn adjustment ring in the bobbin attachment, stable unwinding and uniform twisting of the non-twist yarn can be achieved so that supply of twist yarns to a predetermined machine such as a loom or a warper is possible.

Further in the present invention, as shown in FIG. 2, the spindle is a single spindle having at least two bearings 30 at a middle portion thereof as seen from the front side of a creel body and extending right/leftward to form holders for fixedly supporting the bobbins.

That is, if it is assumed that the spindle rotates in the arrowed direction, a rightside bobbin in FIG. 2 rotates clockwise, while a leftside bobbin rotates counterclockwise as seen from the yarn withdrawal direction.

Accordingly, on the right side in FIG. 2, the non-twist yarn is twisted to be on S-twist by the spindle rotation if the bobbin is positioned so that the yarn unwinding direction is clockwise, while on the left side in FIG. 2, the non-twist yarn is twisted to be a Z-twist by the spindle rotation if the bobbin is positioned so that the yarn unwinding direction is counter clockwise.

If the spindle rotation is opposite to that of the embodiment shown in FIG. 2, the bobbins of the non-twist yarn are, of course, positioned to match whereby Z-twist is imparted in the right side bobbin and S-twist is imparted in the left side bobbin.

In this regard, in a zone in which all the spindles therein are associated with a common drive means, the twisting directions are opposite to each other in the right side bobbin and the left side bobbin, while the rotational speeds, that is, twist numbers thereof are equal to each other.

The spindle drive means comprises a plurality of systems, each consisting of a motor and gearing means. The respective system is adapted to drive a group of spindles belonging thereto so that the rotational direction and the rotational speed can be optionally changed. Thereby, the twist number and/or the twist direction can easily be varied when the quality or thickness of yarns in one spindle group is different from that in an other spindle group, if necessary.

One embodiment of a creel according to the present invention will be described in detail with reference to the drawings.

Figure 1:
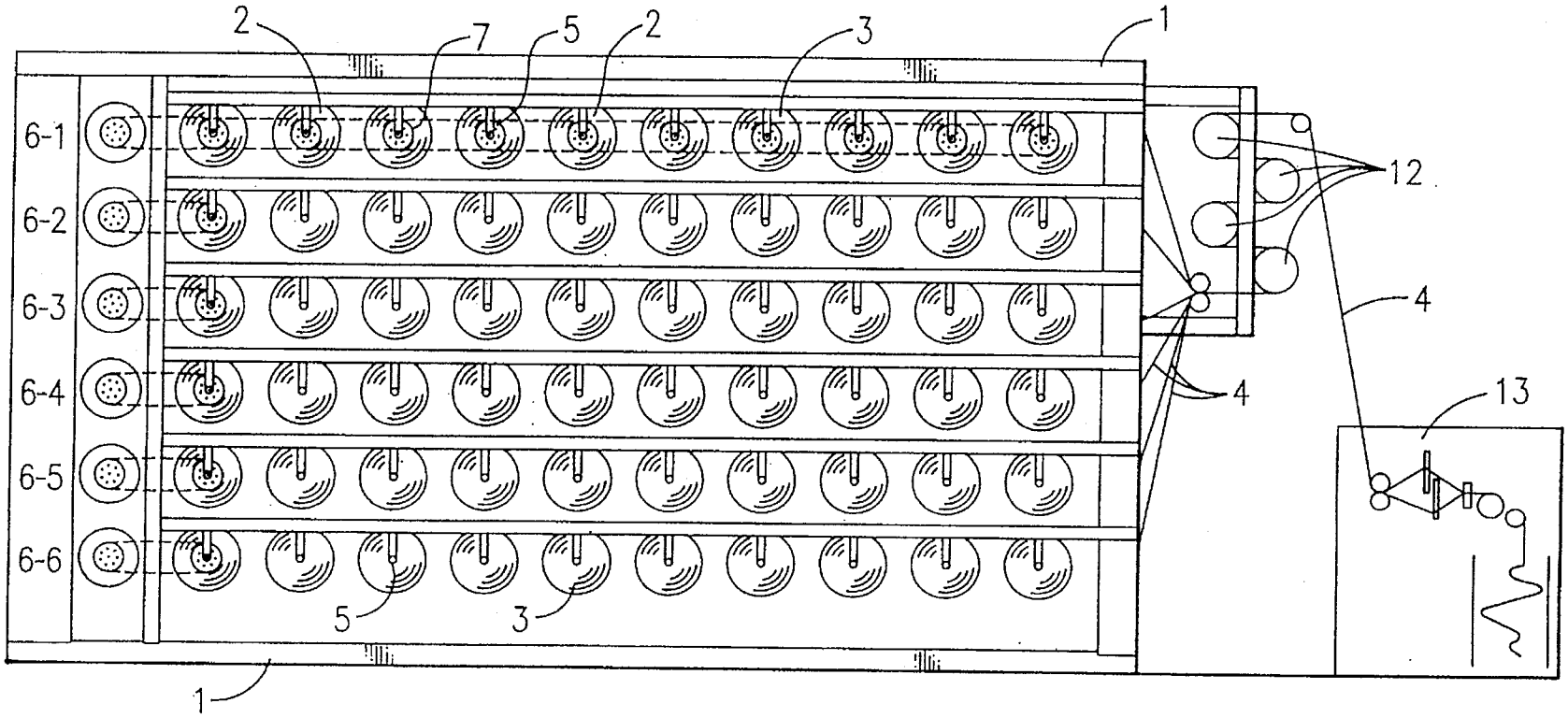
FIG. 1 illustrates one embodiment of a creel structure provided with a twisting apparatus according to the present invention.

FIG. 1 is a side elevational view showing an overall structure of one embodiment of a creel according to the present invention, in which a predetermined number of bobbins 3 (60 on one side and 60 on the other side, total 120 in FIG. 1) are arranged, on each of which a non-twist yarn 2 is wound. The non-twist yarns 2 are unwound and withdrawn from the respective bobbins 3 and supplied in a parallel manner as a sheet of twist yarns 4 to a predetermined machine 13 (for example a loom in FIG. 1) via a group of warping rollers 12.

The predetermined machine 13 may be a warper.

Figure 6:
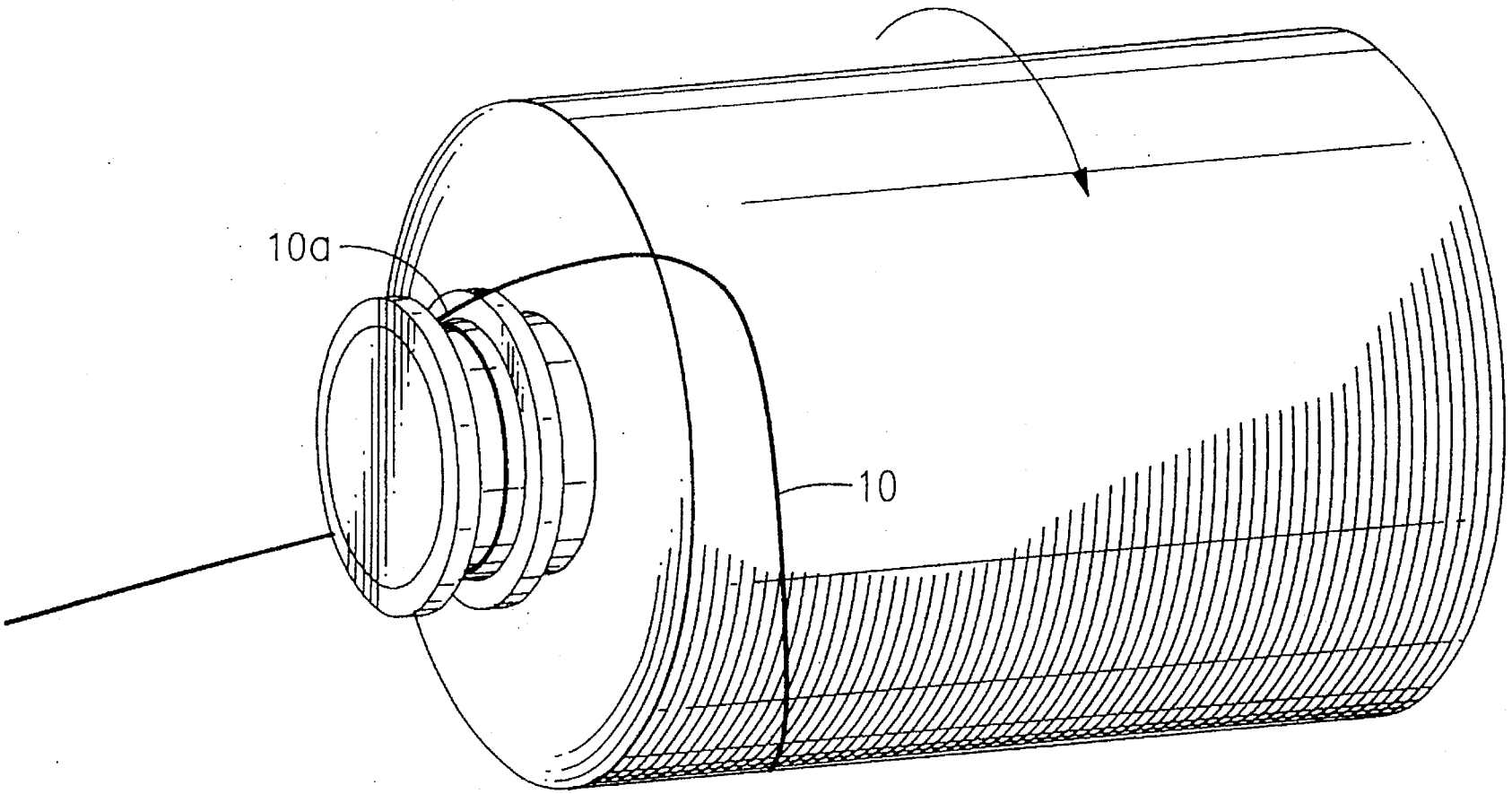
FIG. 6 illustrates a withdrawal of non-twist yarn positioned on a creel according to the present invention.
Figure 7:
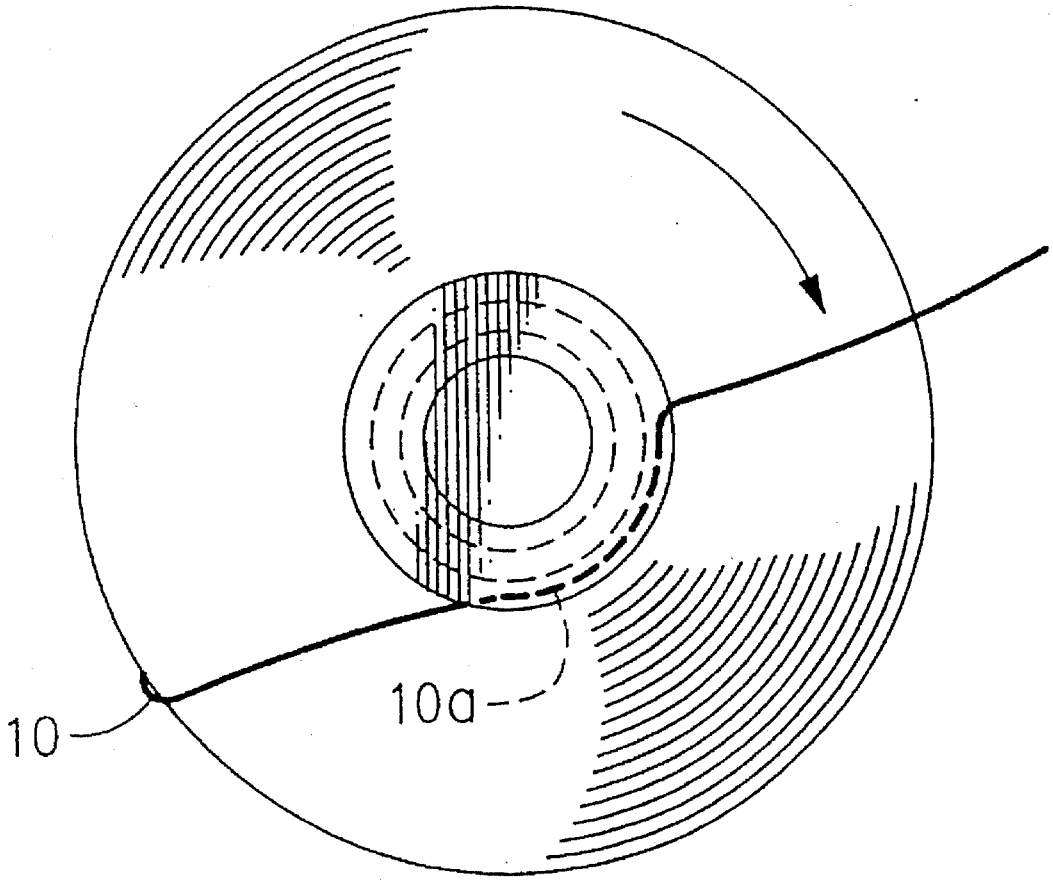
FIG. 7 illustrates the withdrawal of non-twist yarn as seen from the withdrawal side in FIG. 6.

FIG. 2 illustrates on embodiment of a twisting part, in which the creel 1 is provided with spindles 5 for fixedly holding bobbins 3 and is rotatable therewith, a motor 6 and a gearing device 6a for driving the spindles 5. At a free end of the respective bobbin 3, a bobbin attachment 7 is fitted, having a yarn storage 8 on which a yarn adjustment ring 9 is fitted. A shown in FIGS. 6 and 7, as a non-twist yarn 2 wound on the bobbin 3 is unwound and released from the bobbin 3 when the bobbin is rotated by the spindle, a ballooning 10 is generated and a leading end 10*a* thereof enters the yarn storage 8 of the bobbin attachment 7.

The yarn 2 wraps around the periphery of the yarn storage to an extent within one round which varies in accordance with a size of ballooning and then passes by the inner side of the yarn adjustment ring.

Immediately after the yarn has passed by the yarn adjustment ring, a predetermined twist is imparted to the yarn due to the rotation of the bobbin attachment 7.

While the bobbin 3 used in the creel 1 of the present invention is a cylindrical paper tube in FIG. 2, bobbin shapes, materials and structures may be optionally selectable in the present invention. That is, it may be a cylindrical bobbin, a tapered tube or a pirn, except for a double flanged bobbin. Also a yarn wound on the bobbin may be a twistless yarn or a producer's low twist yarn (included in a "non-twist yarn" as defined in the present invention).

In the present invention, if a bobbin is of a type from which a yarn can be withdrawn only in one direction, such as a tapered paper tube, the bobbin cannot be held in a reversed position. In such the case, two kinds of yarn bobbins may be specially prepared in which the yarn unwinding directions thereof are different from each other so that the yarn twisting operation as described above can be similarly applied thereto.

Also, a thickness of the non-twist yarn is not limited but can be optionally selected in accordance with the use of the cloth in which the yarn is woven.

If necessary, the yarns may be wound in a doubled state, whereby the same effect as a double-twist yarn can be obtained.

While six motors are provided on the rear portion of the creel for driving the spindles 5 in FIG. 1, either a single motor or a plurality of motors may be used. Also the motors may be installed either in the upper or lower portion of the creel.

FIG. 2 is a partial view of a twisting mechanism, in which a plurality of spindles 5, not shown, are rotatingly driven by a motor 6 and a gearing device.

The gearing device is not limited to a particular type but may be of a chain drive type, a timing belt type or the like, of which a chain drive type is most preferable because the installation cost is inexpensive.

In FIG. 2, a cylindrical paper tube is used as a bobbin and a single spindle 5 is provided while penetrating two central frames so that bobbins 3*a*, 3*b* are fixedly held on the right and left extending portions, respectively.

This driving system is very simple in structure and greatly contributes to the reduction of installation cost.

Since the bobbin is fixedly positioned on the spindle so that an unwinding direction of a non-twist yarn coincides with that of the spindle rotation, usually it is necessary that the bobbins held on one side of the spindle are reversely inserted onto the spindle relative to the bobbins held on the other side of the spindle.

Accordingly, if the bobbin on the right side of FIG. 2 is held so that the unwinding direction of the non-twist yarn is clockwise, the non-twist yarn is twisted by the spindle rotation to be a S twist. Contrarily, the bobbin on the left side of FIG. 2 is held so that the unwinding direction of the non-twist yarn is counterclockwise, and the non-twist yarn is twisted by the spindle rotation to be a Z twist.

If a bobbin is of a type in which a yarn can be withdrawn from the bobbin only in one direction, it is impossible to reversely hold the bobbin, but in such the case, if two kinds of bobbins are specially prepared in which the yarn unwinding directions of the two kinds of bobbins are opposite to each other, the yarn twisting operation as described above can be similarly applied thereon.

If necessary, spindles may be individually provided on either sides of the creel and driven to rotate in different directions between the right and left side spindles, so that the same directional twist can be imparted. Also in this structure, if the spindle is a hollow spindle so that a core element passes therethrough during the twisting operation, it is possible to use the creel according to the present invention as a covering yarn forming machine.

According to a creel of the present invention, a non-twist yarn 2 is processed to be a twist yarn 4 by unwinding the non-twist yarn from a bobbin 3 while rotating the bobbin 3. A twist number necessary for forming a twist yarn 4 is determined by the bobbin rotation and the withdrawal speed of the non-twist yarn from the bobbin.

Therefore, in the present invention, it is necessary that the creel has a structure for rotating the bobbin 3 in a desired direction and a structure for driving the bobbin at a desired rotational speed.

Also in the present invention, all of twist yarns 4 withdrawn from the creel may have the same twist number and/or the same twisting direction. Alternatively, a part of the twist yarns have a twist number and/or a twisting direction different from that of the other part of the twist yarns.

The bobbins 3 arranged on the creel 1 according to the present invention are preferably rotated as a group in a desired direction by the motor 6 or the gearing device 6*a* in the respective drive system. Preferably the rotational speed of the respective drive system is freely adjustable so that a desired twist number can be obtained in the twist yarn.

Of course, it is possible to drive all the drive systems at the same rotational speed.

That is, with reference to FIG. 1, motors 6-1 through 6-6 are positioned on the rear portion of a creel 1, each of which drives a group of spindles arranged on a horizontal plane through a drive means not shown. Preferably the respective drive system is adapted so that a rotational direction and a rotational speed thereof can be defined independently from other systems.

According to this structure, a twist number corresponding to a thickness and/or the use of a warp yarn can be obtained by changing the rotational speed of the respective drive system.

If necessary, non-twist yarns are supplied as they are while keeping spindles stationary.

The rotational direction can be easily changed by using any of known means for switching the rotational direction, or by varying a wrapping arrangement of a belt or chain.

In one embodiment, a gear box is attached to the motor 6, for reducing the rotational speed of the motor 6 by one tenth. For example, when the motor rotates at 1800 rpm from 60 Hertz current, the output rotational speed is 180 rpm. The rotational speed of the motor is controlled by frequency modulation through an inverter under the supervision of a controller in this embodiment. The frequency varies from 0 Hertz to 120 Hertz, which theoretically corresponds to the output rotational speed of 0 rpm through 360 rpm.

While one group of spindles arranged in one horizontal plane are driven by the respective drive system including one motor in FIG. 1, it may be possible to drive a plurality of spindle groups by one motor by providing a plurality of gearing means. A distance between the adjacent spindles is determined by taking a size of bobbin usually used and an amount of yarn wound thereon into account.

Various examples in which a cloth is woven while using a creel according to the present invention will be described below, in which a narrow width needle loom is used for weaving two tape cloths.

1) When the motors 6-1 through 6-6 are driven to rotate in the same direction and at the same rotational speed, the twist number is equal in all the bobbins but the twisting direction in one side bobbin is different from that in the other side bobbin as seen from the front side of the creel. In this case, if yarns on the respective sides are allocated to the right and left sides of the loom, the resultant right and left cloths are composed of yarns having different twist directions from each other.

2) If Z-twist yarns and S-twist yarns are respectively grouped between the exit of the creel and the warping rollers 12, S-twist yarns and Z-twist yarns of a predetermined width alternate in the left side cloth and the right side cloth on the loom. If a herring-bone twill is woven by using the same directional twist yarns, an appearance of twill line is different in accordance with the twill direction. According to this method, it is possible to change the twisting direction in every twill line so that the appearance becomes even throughout the surface of the resultant cloth. It is easy for a person with ordinary skill in the art to group the yarns as stated above in accordance with the specification of the desired cloth.

3) If the motors 6-1, 6-3 and 6-5 are rotated in one direction and the motors 6-2, 6-4 and 6-6 are rotated in the opposite direction to the former, Z-twist yarns and S-twist yarns are mixed in the respective side of the creel 1. The left side yarns and the right side yarns on the creel are supplied to the loom as they are so that left and right tape cloths are woven on the loom. In general, when relatively hard twist yarns, each twisted in the same direction are used for weaving a cloth, there is a drawback in that the resultant cloth is liable to be distorted. Contrarily, in the abovesaid cloth, the Z-twist yarns and the S-twist yarns are mixed and balanced in one cloth, whereby no distortion occurs in the resultant cloth.

4) If one wishes to use yarns having different thicknesses and/or different twist numbers in one tape cloth, the respective motors 6-1 through 6-6 are driven at optional rotational speeds so that the warps have desired twist numbers. If necessary, some of the motors may be stopped so that non-twist yarns are supplied.

5) If all the motors are kept stationary, only non-twist yarns or twist yarns can be supplied as they are in the same manner as the conventional creel.

While the above description was given for the case in which a creel is used for supplying yarns to a loom, the present invention is not limited to this case but can be used for supplying yarns to a warper. In this regard, if the creel is used for the warper, it is necessary that a motor and a gearing means are designed in a high speed manner, because the winding speed of the warper is far higher than that of the loom.

Next, a method for twisting a non-twist yarn while using a bobbin attachment and a yarn adjustment ring will be explained in detail below.

The twisting method according to the present invention is novel and very simple compared with any conventional twisting methods, whereby a twisting cost can be reduced.

For example, when a narrow width cloth is woven by a needle loom at a weaving speed of 2000 pick/min, a warp supply speed is about 1.5 m/min if a weft is picked at a rate of 33 pick/inch, and about 3.0 m/min if a weft is picked at rate of 16.5 pick/inch. Since the weaving speed is relatively low as described above, to obtain a twist yarn having a twist number of 100 t/m, it is sufficient to rotate the bobbin at 150 rpm if a warp is supplied at 1.5 m/min, and at 300 rpm if a warp is supplied at 3.0 m/min. At such a relatively low speed, there is no practical problem even if manufacturing accuracies of spindle, bobbin holding means and bobbin attachment are relatively low.

Basically, a yarn is twisted only when the yarn is withdrawn from a bobbin while the bobbin is rotated in the yarn unwinding direction. However, when the bobbin is merely rotated, a twist number becomes unstable because the respective position at which the yarn twisting is initiated varies due to the variation of ballooning size in accordance with the change of positions on the bobbin at which the yarn is released. In the extreme case, the yarn release itself becomes difficult because the released yarn is wrapped around the bobbin or entangled with the adjacent yarn, which causes a yarn breakage and results in the interruption of the weaving operation. The present invention aims to solve such problems by absorbing the ballooning fluctuation so that a yarn is released in a stable state so as to fix a position at which a twisting is initiated and to maintain a yarn tension substantially at a predetermined level.

That is, the twisting system according to the present invention is characterized by two elements; one is a bobbin attachment 7 consisting of a part by which it is fixed on the bobbin and a yarn storage 8 for temporarily storing a yarn length released from the bobbin which fluctuates due to the ballooning, so that the yarn releasing length is compensated, and the other is a yarn adjustment ring 9 mounted on the tip end of the yarn storage for restricting a non-twist yarn so as not to be freely released from the bobbin so that the excessive yarn length is wrapped around the yarn storage if necessary and a predetermined tension is imparted to the yarn. In this connection, the yarn adjustment ring serves to determine a position from which the twisting operation is initiated on the yarn.

The bobbin attachment 7, the yarn storage 8 and the yarn adjustment ring 9 will be described in more detail below.

Figure 3:
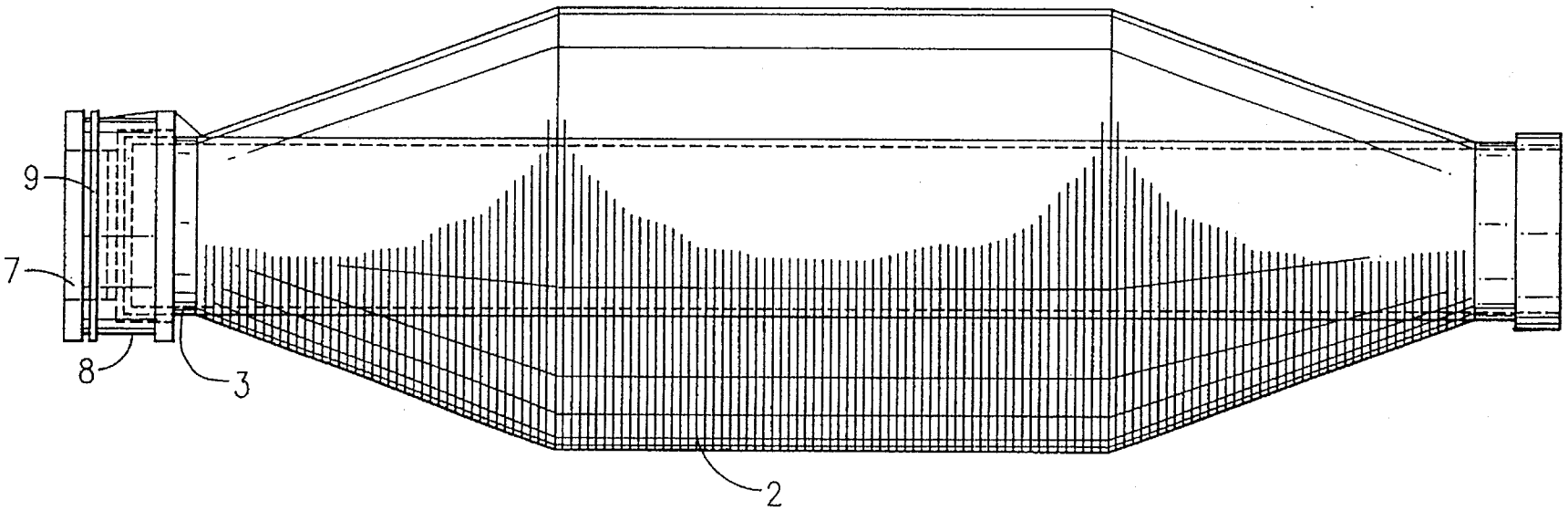
FIG. 3 illustrates a winding shape of non-twist yarn formed on a bobbin (aluminum pirn) provided with a bobbin attachment according to the present invention.
Figure 5A:
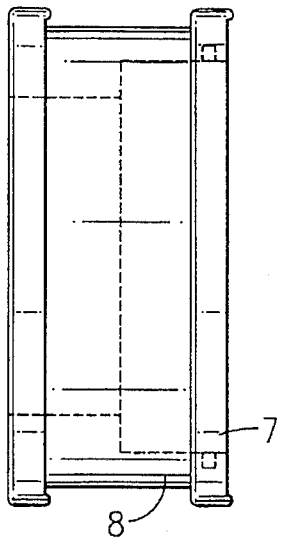
Figure 5B:
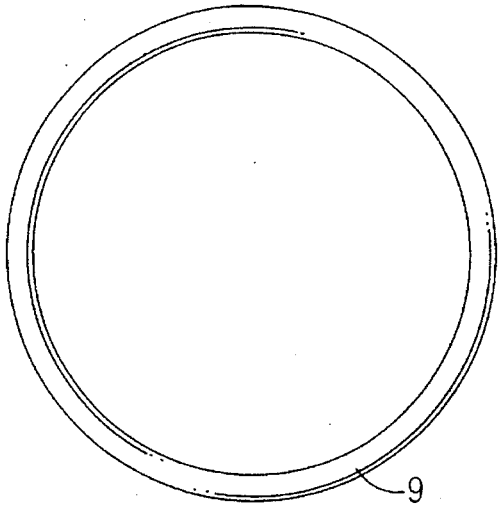

FIG. 5(A) illustrates a side view of one embodiment of a bobbin attachment 7 according to the present invention, which is suitably used for an aluminum pirn shown in FIG. 3. FIG. 5(B) illustrates one embodiment of a yarn adjustment ring 9 used while mounted on the bobbin attachment shown in FIG. 5(A), which is preferably an O-ring defined by JIS and made of a synthetic rubber.

The yarn adjustment ring 9 may be of any other type, provided it has a predetermined elasticity and friction so that a non-twist yarn 2 is braked thereby not to freely be released from the bobbin, whereby a predetermined tension is imparted to a twist yarn.

Figure 5C:
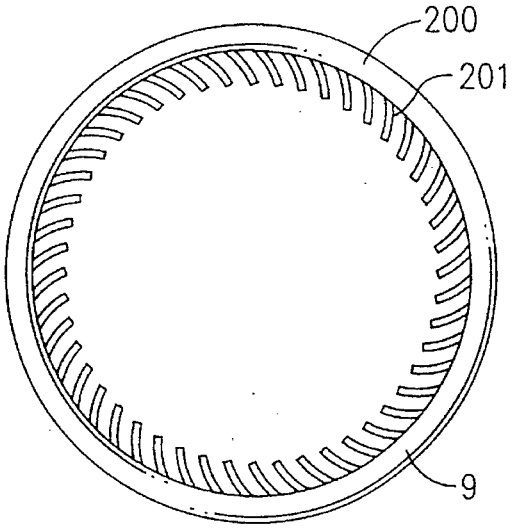

While any materials may be used for the yarn adjustment ring 9 provided the abovesaid functions are obtained, one selected from synthetic resins, synthetic rubbers and natural rubbers may be preferably used. The yarn adjustment ring is not limited to a mere ring but may be provided with a plurality of whisker-like projections 201 slanted in one direction on the innerside a ring body 200 made of a synthetic resin as shown in FIG. 5(C).

Figure 4:
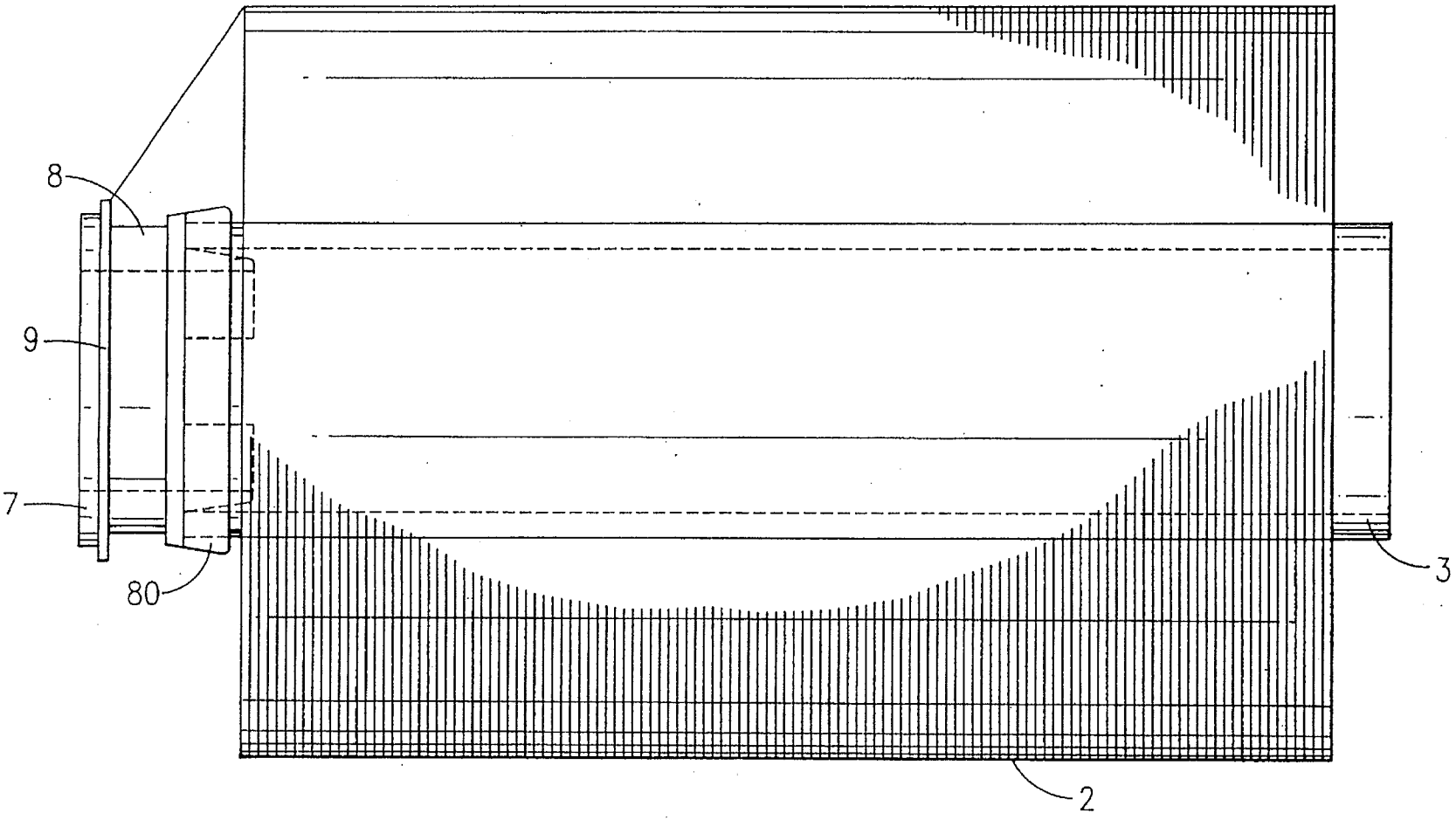
FIG. 4 illustrates another winding shape of non-twist yarn formed on a bobbin (cylindrical paper tube) provided with a bobbin attachment according to the present invention.

The yarn storage 8 according to the present invention is provided on the outer periphery of the bobbin attachment 7 as a groove having a proper width and depth. The width and depth of the yarn storage 8 are preferably determined to be the optimum dimensions by mainly taking a ballooning shape varying in accordance with the kind of non-twist yarn wound on the bobbin 3, yarn thickness, number of filaments, twist number, yarn releasing speed and bobbin rotational speed into account as well as secondarily taking a material, elasticity and friction of the yarn adjustment ring into account. In any case, the yarn storage is necessarily designed so that the leading end of the ballooning can enter in the yarn storage even though the non-twist yarn is withdrawn from the bobbin at any point thereof. For this purpose, as shown in FIG. 4, a hood 80 is preferably provided on the bobbin attachment 7 closer to yarn layers on the bobbin for covering the bobbin.

While a size of the yarn ballooning varies in the creel according to the present invention upon the release of yarn from the bobbin in accordance with various factors, such as a yarn material, yarn thickness, package diameter, yarn releasing position or a bobbin rotational speed, the ballooning largely expands when the yarn is withdrawn from a forward region of the bobbin, and hardly expands when it is withdrawn from a rear region of the bobbin.

This means that a delivered yarn length is longer when the ballooning largely expands and is relatively shorter when it does not expand. On the other hand, since the yarn is taken up at a constant speed, the yarn may be entangled around a bare surface of a bobbin end on which no yarn layer is formed when the ballooning size is large, if the yarn is released as it is. Accordingly, the present invention provides the yarn storage 8 on the bobbin attachment mounted at the bobbin end so that the yarn is wrapped around the yarn storage.

However, since it has been found that the yarn releasing state is still unstable according to the above structure, the yarn adjustment ring 9 is mounted at the end of the yarn storage 8, so that the yarn releasing and twisting can be more stably carried out. Since the withdrawn yarn is restricted by the yarn adjustment ring 9, it is released from the bobbin while being hardly wrapped around the yarn storage 8 when the ballooning size is small, and the yarn is released from the bobbin while wrapped around the yarn storage 8 so that the released length is adjusted when the ballooning size is larger. In this regard, a length of the wrapped yarn did not exceed one round of the periphery of the yarn storage 8.

However, since the fluctuation of yarn tension becomes large when an excessive resistance is added to the wrapped yarn portion, the yarn storage surface is preferably as smooth as possible so as to minimize the tension fluctuation. The same effect is obtained by providing a slight taper on the yarn storage 8 toward an exit; i.e., the yarn adjustment ring 9. In this embodiment, the bobbin attachment is manufactured by a molding of plastics, which is relatively inexpensive.

While the above description was given for the structures and functions when the creel is used as a twisting apparatus, the creel can be used as a covering yarn forming machine provided the spindle is of a hollow type, through which a core element is supplied.

In FIG. 1, the warping rollers 12 are arranged between the creel 1 and the predetermined machine (loom) 13, which rollers have a function to absorb a tension unevenness in a group of yarns, if any. If an excessive tension is applied to yarns when they are twisted, which is not adequate for a yarn material or a yarn thickness, a sensor for detecting the weaving tension and positively delivering the yarns may be provided in the above group of rollers.

As shown in FIG. 2, a single spindle 5 has at least two bearings in a central portion thereof as seen from the front side of the creel, and is adapted to fixedly hold bobbins on both sides of the group of bearings.

When the single spindle rotates in one direction, the right side thereof rotates clockwise as seen from a releasing direction of a non-twist yarn in FIG. 2, while the left side thereof rotates counterclockwise.

Accordingly, the bobbin is positioned on the spindle so that the bobbin rotates in the unwinding direction by the rotation of the spindle, whereby a non-twist yarn withdrawn from the right side bobbin is twisted in an S-twist and that from the left side bobbin is twisted in a Z-twist.

As long as the spindles are driven by the same driving means, the right side yarn and the left side yarn are twisted in directions opposite to each other, while the rotational speeds are equal to each other, whereby the twist numbers are equal to each other.

With reference to FIG. 2, a plurality of spindles 5 not shown are driven by the motor 6 and the gearing device *6a*.

The gearing device for transmitting a torque from the motor 6 to the spindle 5 is of any type such as a chain drive type or a timing belt drive type, of which the chain drive type is particularly preferable form the view point of the reduction of installation cost.

FIG. 1 illustrates an embodiment in which a group of 10 spindles are arranged parallel to each other in a horizontal direction as seen from the lateral side of a creel and 6 groups of the spindles are arranged in a multistage manner in a vertical direction. Six motors are associated with the respective spindle groups in the horizontal direction. Alternatively, all the spindles are driven in one direction by a single motor and a gearing device while the rotational speed thereof is variable. Of course, a plurality of motors may be used instead of the single motor, and may be positioned either on the upper area or on the lower area of the creel.

Of them, the spindle drive mechanism is preferably structured by a plurality of groups, each consisting of a motor and a gearing device and adapted to rotate a group of spindles in a desired direction at a desired rotational speed.

In FIG. 1, six motors 6-1 through 6-6 are positioned on the rear portion of the creel 1, each of which drives a horizontal group of spindles by a gearing device not shown. Preferably the respective drive system is adapted to drive the spindle in the group so that the rotational direction and the rotational speed are optionally selected.

In the above description, while a combination of the bobbin attachment and the yarn adjustment ring is used as a twisting mechanism, the present invention should not be limited thereto but may be used with another twisting mechanism such as a known ring-traveller type mechanism.

The creel according to the present invention has the following effects derived from the above structural characteristics:

1) Since counterproductive operations inherent to the use of twist yarns, such as a threading operation onto a twister or an unwinding operation from a twist bobbin, can be eliminated, a productivity is improved in terms of manufacturing time or cost.

2) A yarn weight (length) wound on a bobbin is less than that of a large packaged bobbin marketed from a yarn producer when a preliminarily twisted yarn is used. Contrary thereto, it is possible to use the large packaged bobbin as it is according to the present invention.

3) The present invention is very simple in structure compared to the conventional twisting system such as a flyer system or a ring-traveller system, and requires much fewer parts. In addition, all the parts are commercially available except for a bobbin attachment. As a result, the twisting mechanism can be manufactured at a lower cost whereby the production cost of a desired cloth can be drastically reduced.

4) According to the creel of the present invention, in addition to the above effects, even when the S-twist yarns are used mixed with Z-twist yarns, the possibility of an erroneous yarn arrangement can be avoided. By mixing the S- and Z-twist yarns in one cloth, it is possible to easily avoid distortion of the resultant product.

5) It is possible to easily impart a suitable twist number to a yarn in accordance with the variation of the material, thickness and use thereof.

6) When a multifilament yarn is twisted to be a relatively hard twist yarn, the operability thereof is worsened by a snarl in the twisted yarn due to the untwisting phenomenon, whereby an anti-snarl treatment is necessary. According to the present invention, such an anti-snarl treatment is unnecessary.

7) Since a yarn having a desired twist number can be supplied directly to a loom, a tough product having a good feeling to the touch and a superior abrasive durability can be obtained. This product also has a superior appearance without yarn damage compared with a product obtained from preliminarily twisted yarns.

8) Since a driving device has an ability to vary a spindle rotational speed in the present invention, it is possible to easily change the twist number while the weaving operation is being conducted, whereby the feeling to the touch of the product is adjustable while one is observing the same.

9) It is known that a twist yarn obtained by a twister is generally has an inferior breakage strength relative to an original non-twist yarn. On the contrary, a breakage strength of a twist yarn according to the present invention is hardly lowered relative to the original yarn. Accordingly, the twisting system of the present invention is very useful for the production of a seat belt or the like in which a very large breakage strength is required.

We claim:

1. A creel for supplying twist yarns arranged parallel to each other to a predetermined machine, said twist yarns being prepared by withdrawing a non-twist yarn from one of multiple bobbins arranged on the creel and twisting the non-twist yarn midway of a supply passage to the predetermined machine, said creel comprising a plurality of spindles, each fixedly supporting the respective bobbin, and at least one means for driving the spindles in an optional rotational direction and at an optional rotational speed, and an attachment having a yarn storage, said attachment being mounted at a tip end of the bobbin supported on the spindle and said yarn storage having a yarn adjustment ring fitted thereon, wherein after the non-twist yarn withdrawn from the bobbin passes the yarn storage and the yarn adjustment ring while being directed to the predetermined machine, a twist is imparted to the non-twist yarn to obtain a twist yarn.

2. A creel, comprising a plurality of spindles, each fixedly supporting a bobbin on which a non-twist yarn is wound so that the bobbin is rotatable together with the spindle and at least one means for driving spindles, in which a twist is imparted to the non-twist yarn while the non-twist yarn is withdrawn from the bobbin and supplied to a predetermined machine, wherein each of the spindles is a single spindle having at least two bearings in a middle portion thereof as seen from a front side and extending rightward and leftward to form holders for fixedly supporting the bobbins, and said plurality of the spindles are arranged to form multiple horizontal rows positioned in a multistage manner in the vertical direction as seen from a lateral side; said spindle driving means comprising a motor and gearing means for driving all the spindles at a variable speed in a predetermined rotational direction, wherein a rotational speed of the motor can be varied.

3. A creel as defined by claim 1 or 2, wherein the means for driving spindles is a plurality of systems, each comprising a motor and a gearing means so that the respective system can change the rotational directionand the rotational speed of the spindle.

4. A creel as defined by claim 3, wherein the predetermined machine is a loom or a warper.

5. A creel as defined by claims 1 or 2 wherein the predetermined machine is a loom or a wrapper.

6. A creel according to claim 1, further comprising a fabric forming device, wherein said twist yarns are supplied thereto from said creel and wherein said predetermined machine is a fabric formimng device serially arranged with said creel, the twisted yarns being directly and continuously supplied from said creel to said fabric forming device.

7. A creel according to claim 1, further comprising a warp beam forming device, wherein said twist yarns are supplied thereto from said creel and wherein a fabric forming device is serially arranged with said creel, the twisted yarns being directly and continuously supplied from said creel.

8. A creel according to claim 2, further comprising a fabric forming device, wherein said twist yarn is supplied thereto from said creel and wherein said predetermined machine is a fabric formimng device serially arranged with said creel, the twisted yarns being directly and continuously supplied from said creel to said fabric forming device.

9. A creel according to claim 2, further comprising a warp beam forming device, wherein said twist yarn is supplied thereto from said creel and wherein a fabric forming device is serially arranged with said creel, the twisted yarns being directly and continuously supplied from said creel.

* * * * *